US006598649B1

(12) United States Patent
Moore et al.

(10) Patent No.: US 6,598,649 B1
(45) Date of Patent: Jul. 29, 2003

(54) FREESTANDING ROOM DIVIDER

(75) Inventors: Gregory C. Moore, Belton, TX (US); Michael J. Mackie, The Woodlands, TX (US)

(73) Assignee: Best-Rite Manufacturing, Temple, TX (US)

( * ) Notice: Subject to any disclaimer, the term of this patent is extended or adjusted under 35 U.S.C. 154(b) by 0 days.

(21) Appl. No.: 10/016,774

(22) Filed: Dec. 10, 2001

(51) Int. Cl.[7] ..... A47G 5/00
(52) U.S. Cl. ..... 160/135; 160/351
(58) Field of Search ..... 160/135, 351, 160/352; 52/239, 238.1

(56) References Cited

U.S. PATENT DOCUMENTS 3,463,218 A * 8/1969 Cannon et al. ..... 160/135
3,674,081 A * 7/1972 List ..... 160/135
4,085,789 A * 4/1978 Steiner et al. ..... 160/135
4,118,903 A * 10/1978 Coulthard ..... 160/351 X
4,200,254 A * 4/1980 Nelson ..... 160/351 X
4,457,117 A * 7/1984 Leiher et al. ..... 52/239 X
5,259,164 A * 11/1993 Wiese ..... 160/135 X
5,272,848 A * 12/1993 Maas ..... 160/135 X
5,431,210 A * 7/1995 Nelson et al. ..... 160/135

* cited by examiner

*Primary Examiner*—David Purol
(74) *Attorney, Agent, or Firm*—Wendy Buskop; Buskop Law Group, P.C.

(57) ABSTRACT

A freestanding room divider comprising a first panel comprising a first top, a first bottom, a first right side, a first left side; a second panel comprising a second top, a second bottom, a second right side, a second left side; a first rail attached to the first bottom; a second rail attached to the second bottom; a first panel first brace and a first panel second brace for engaging the first rail, and a second panel first brace and a second panel second brace for engaging the second rail and wherein first and second braces each further comprises at least one vertical member attached to at least one horizontal member; a first pin and a second pin disposed on the first top; and a third pin and a fourth pin disposed on the second top; and a bar having a first end and second end wherein the first end engages the second pin and the second end engages the third pin connecting the panels.

12 Claims, 7 Drawing Sheets

FREESTANDING ROOM DIVIDER

FIELD OF THE INVENTION

The present invention relates generally to room dividers, more particularly, it relates to portable, freestanding room dividers. There are times that it is desired to divide large areas, such as rooms or halls, into smaller more private areas. Noise levels may also be reduced within the area. One method of doing this is by the use of movable wall panels, which are suspended from and move on tracks attached to the ceiling and/or floor. This method is relatively expensive and it is inflexible. The present invention seeks to overcome these drawbacks.

BACKGROUND OF THE INVENTION

Another method of dividing large areas into smaller private areas is to use movable freestanding walls. This method is relatively inexpensive and it permits the formation of areas of a wide variety of shapes, but the presently available freestanding walls present storage and handling problems. Sound is known to both be an environmental health hazard and has a disruptive effect on productivity in the work place. The wall panel can include materials, which provide many environmental benefits such as noise level reduction in addition to fire retardation and light absorbency. Current belief is that a reduction in noise level of 5 decibels can cut the risk of hearing loss by 50 percent. A study by the American Society of Interior Designers have found that 70% of office employees felt that their productivity was reduced due to noise, however this study also found that 81% of executives were not aware that a noise problem existed.

There is a need for a portable, freestanding room divider for dividing large areas into a wide variety of different shaped smaller and more private areas, which does not present storage and handling problems.

BRIEF SUMMARY OF THE INVENTION

It is an object of the present invention to disclose an inexpensive, portable, freestanding room divider for dividing large areas into smaller private areas, which can be one panel or a plurality of panels connected together in a flat or ring design.

It is a further object to disclose a portable, freestanding room divider, which does not present the storage, and handling problems of prior art freestanding panel units.

The apparatus of the present invention comprises in one embodiment a plurality of foldable panels, which can be unfolded to form a wall or connected to form a ring shape. Each wall panel has at least two braces and T-shaped supports on rolling means, such as wheels, casters or rolling balls with claw devices; the panels are connected by bars or tubes, which can be telescoping and mounted on pins at each end of the top of the panel, opposite the braces and T-shaped supports.

In a preferred embodiment, the wall panels are mounted on rolling means such as wheels, casters or rolling balls with claw devices. The means for joining the panels can be supplemented with hinges bolted to two adjoining panels, which aid in keeping the panels connected together.

The present invention comprises a freestanding room divider comprising a first panel comprising a first top, a first bottom, a first right side, a first left side; a second panel comprising a second top, a second bottom, a second right side, a second left side; a first rail attached to the first bottom; a second rail attached to the second bottom; a first panel first brace and a first panel second brace for engaging the first rail, and a second panel first brace and a second panel second brace for engaging the second rail and wherein first and second braces each further comprises at least one vertical member attached to at least one horizontal member; a first pin and a second pin disposed on the first top; and a third pin and a fourth pin disposed on the second top; and a bar having a first end and second end wherein the first end engages the second pin and the second end engages the third pin connecting the panels.

It will be apparent to those skilled in the art from the description that follows that the aforementioned and other objects can be achieved by the apparatus of the present invention.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENT

Figure 1:
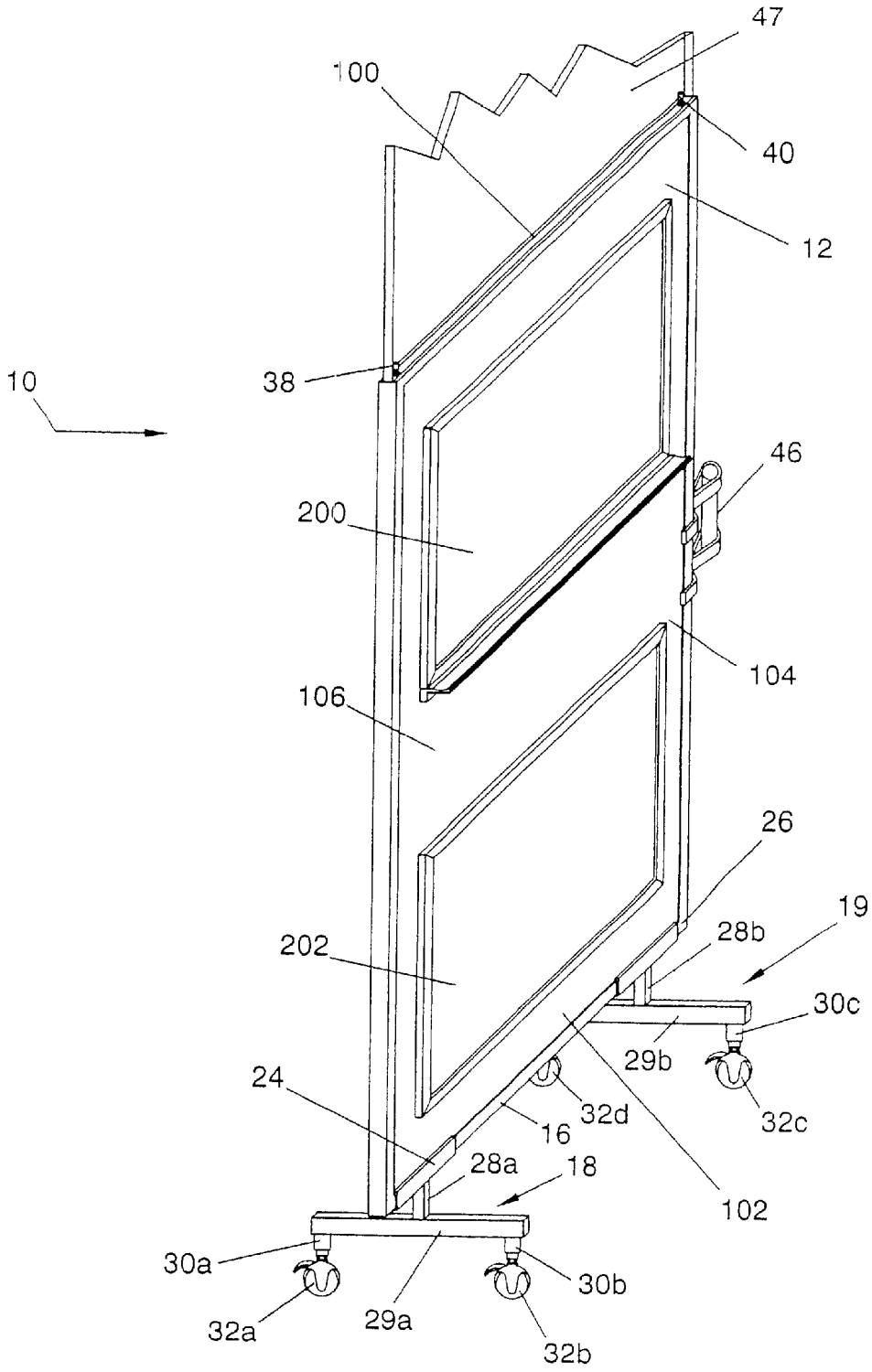
FIG. 1 is a perspective view of the portable, freestanding, room divider of the present invention.

In FIG. 1 a first wall panel 12 is shown for a freestanding room divider 10 made from at least one panel having four sides: a first top 100, a first bottom 102, a first right side 104 and a first left side 106. The invention may optionally have a second panel having four sides: a second top 200, a second bottom 202, a second right side 204 and a second left side 206 (see FIG. 5). Further, it is within the scope of the invention to have multiple panels secured together. The panels may be manufactured from sound absorbing and fire retardant materials, which may include polyolefin, polyester, acrylic, flame retardant urethane/latex and fire-proof melamine as well as other sound absorbing and fire retardant materials well known in the art. The scope of the invention is therefore not limited to only these sound absorbing and fire retardant materials. Panels may be fire rated in accordance with ASTM E-84 Class 1. Noise Reduction Coefficients (NRC's) typically average to values in the range of 0.75 to 1.05 with respect to sound frequencies of 125 to 4,000 Hertz (Hz). A first rail 16 is mounted on or attached to the first bottom side 102 of the first wall panel 12. The first rail 16 is attached to at least two braces: a first panel first brace 24 and a first panel second brace 26, which in a preferred embodiment the braces are U-shaped. First panel first brace 24 is attached to a first vertical member 28*a*, which attaches to first horizontal member 29*a*. First panel second brace 26 is attached to a second vertical member 28*b*, which attaches to a second horizontal member 29*b*. When horizontal members 29*a* and 29*b* are attached to vertical members 28*a* and 28*b*, respectively, they form T-shaped supports: a first T-shaped support 18 and a second T-shaped support 19, respectively. Each T-shaped support can optionally have at least two vertical segments with first vertical segment 30*a* secured to one end of first horizontal member 29*a* and a second vertical segment 30*b* secured to the other end of first horizontal member 29*a*; a third vertical segment 30*c* secured to one end of second horizontal member 29*b* and a fourth vertical segment (see FIG. 5) secured to the other end of the of second horizontal member 29*b*. It is within the scope of the invention as shown in FIG. 5, when two or more panels are used to construct a freestanding room divider each panel has a rail attached to the bottom of the panel. Specifically, the second panel has a second rail secured or otherwise attached to the bottom of the second panel. It is noted that the same would apply when multiple panels are used to construct a freestanding room divider. Specifically, each panel has a rail secured or otherwise attached to the bottom of each of the panels. It is within the scope of the invention to optionally have additional T-shaped supports with optional additional vertical segments. It is also within the scope of the invention to optionally have additional braces secured to these additional T-shaped supports. Each vertical segment can be secured to rolling means or wheels. FIG. 1 shows rolling means 32*a* which is attached to vertical segment 30*a*, rolling means 32*b* which is attached to second vertical segment 30*b*, rolling means 32*c* which is attached to third vertical segment 30*c* and rolling means 32*d* which is attached to fourth vertical segment (see FIG. 5). Baffles 47 (see FIG. 4) can be mounted upward on the top of the panel to increase the panel noise reduction efficiency. Multiple baffles optionally can be mounted on the top of one or more panels used in the freestanding room divider. A first panel pin 38 and a second panel pin 40 are disposed on each of the ends, a first end and a second end of the top 100 of the panel 12. Handles 46 may be mounted on the sides of the panels to facilitate moving the panels on the wheels.

Figure 2:
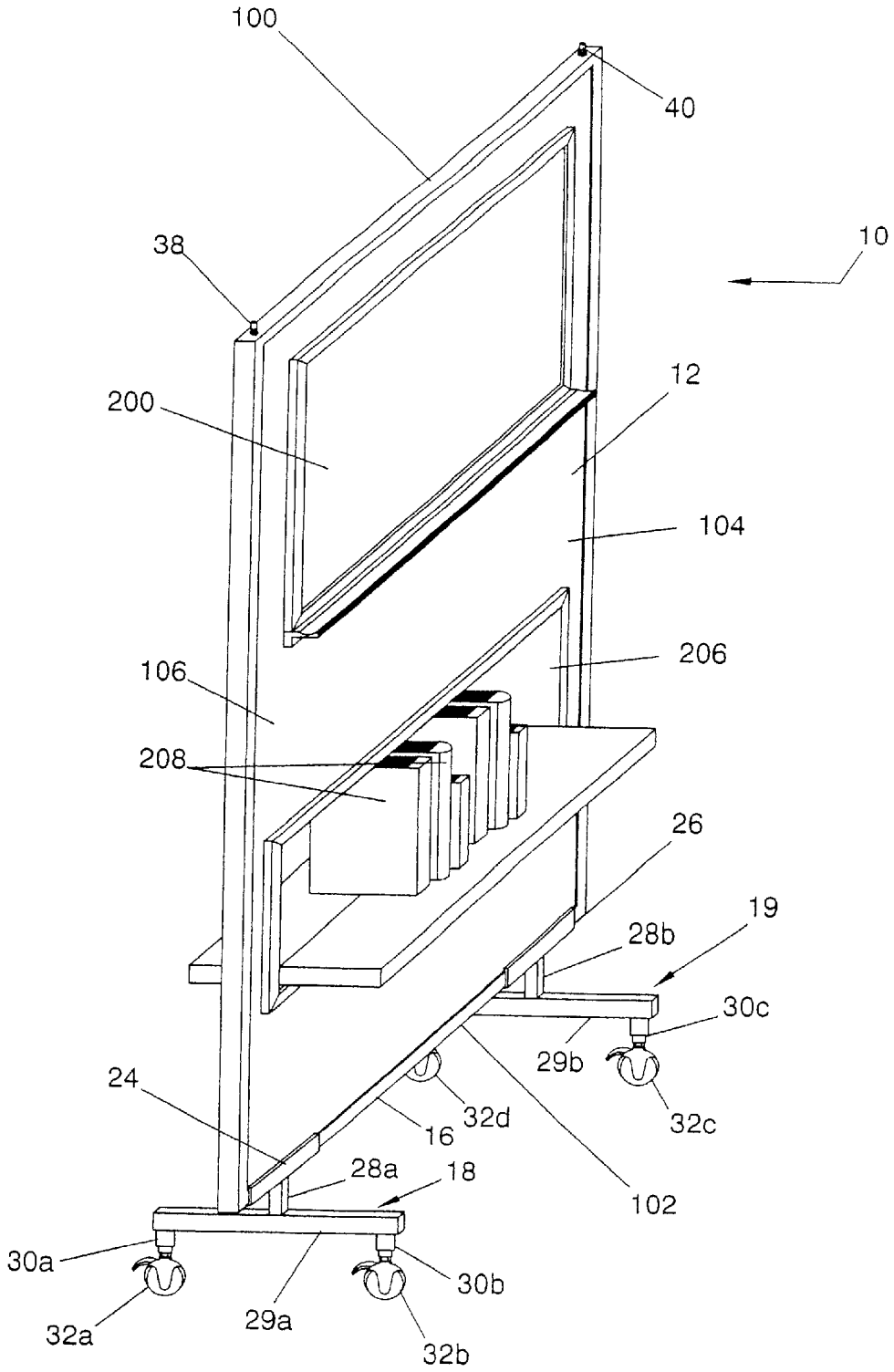
FIG. 2 is another view of the embodiment of FIG. 1 without the handles.

FIG. 2 is similar to FIG. 1; however, it illustrates panel 12 without handles.

Figure 3:
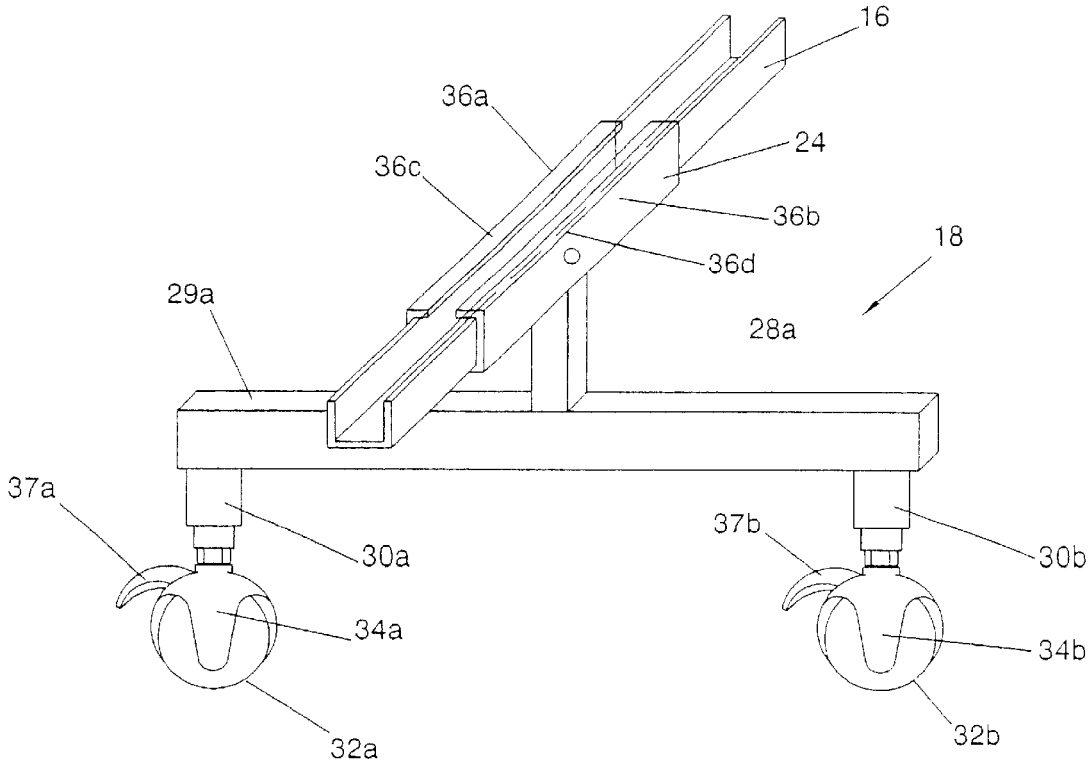
FIG. 3 is a side view of one of the T-shaped supports.

FIG. 3 shows the one of the T-shaped supports with an attached brace in detail. Rail 16 slidably engages brace 24, which may optionally include a plurality of locking lips 36*a*, 36*b*, 36*c* and 36*d*, which secure the braces to the panels for additional stability and security. The T-shaped support 18 has a vertical member 28*a* and a horizontal member 29*a*. The brace 24, horizontal member 29*a* and vertical member 28*a* are most preferably made of metal, but could be made from a graphite composite, a laminate structure of metal and plastic, or an extremely durable plastic.

In a preferred embodiment, rolling means 32*a* and 32*b* can be wheels, casters or rolling balls with fixed claws 34*a* and 34*b*, respectively, disposed over the rolling balls for smooth rolling. The rolling balls with claws further can each comprise a self-leveling device.

Locking means 37*a* is mounted on the fixed claw 34*a* in a preferred embodiment for locking the rolling ball 32*a* and preventing rolling of the room dividers 10. Locking means 37*b* is mounted on the fixed claw 34*b* in a preferred embodiment for locking the rolling ball 32*b* and preventing rolling of the room dividers 10.

Figure 4:
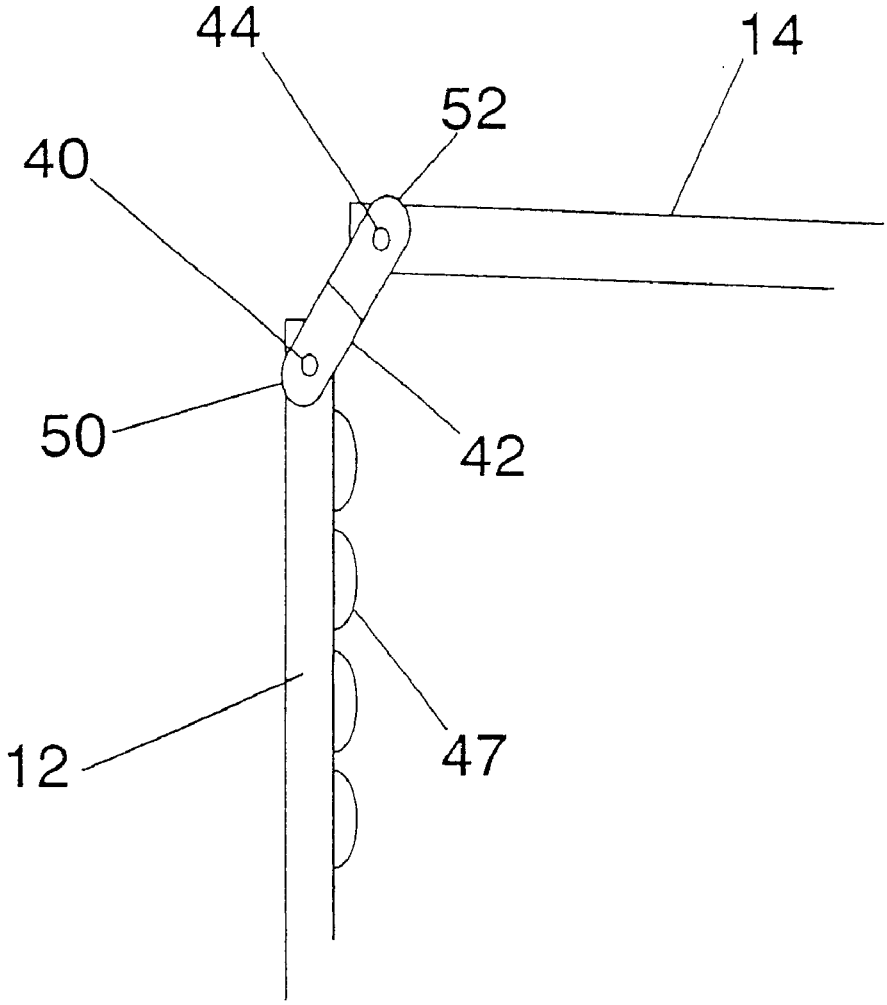
FIG. 4 is the top view of two panels connected by a bar.
Figure 5:
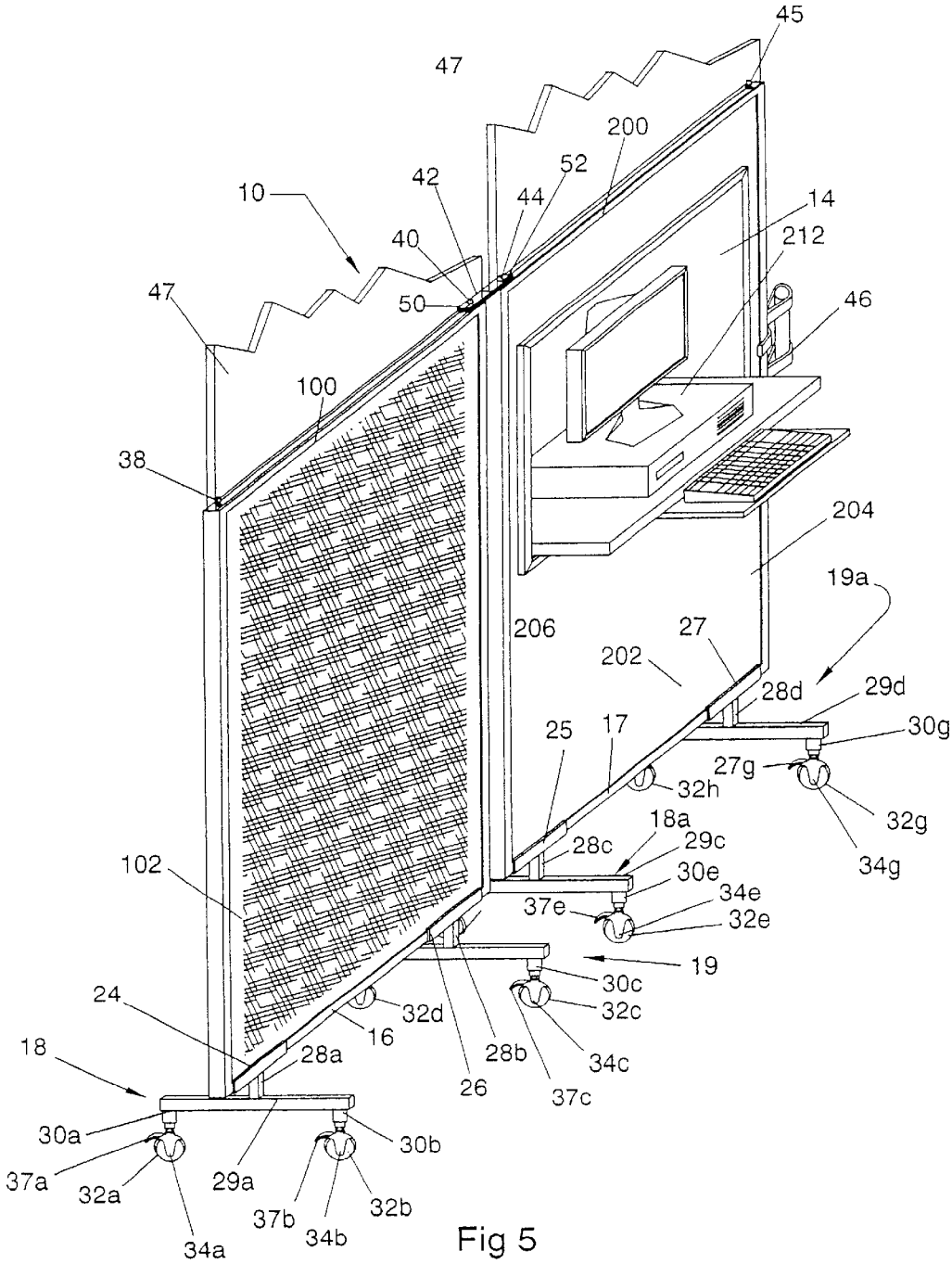
FIG. 5 is a view of two panels connected by a bar.
Figure 7:
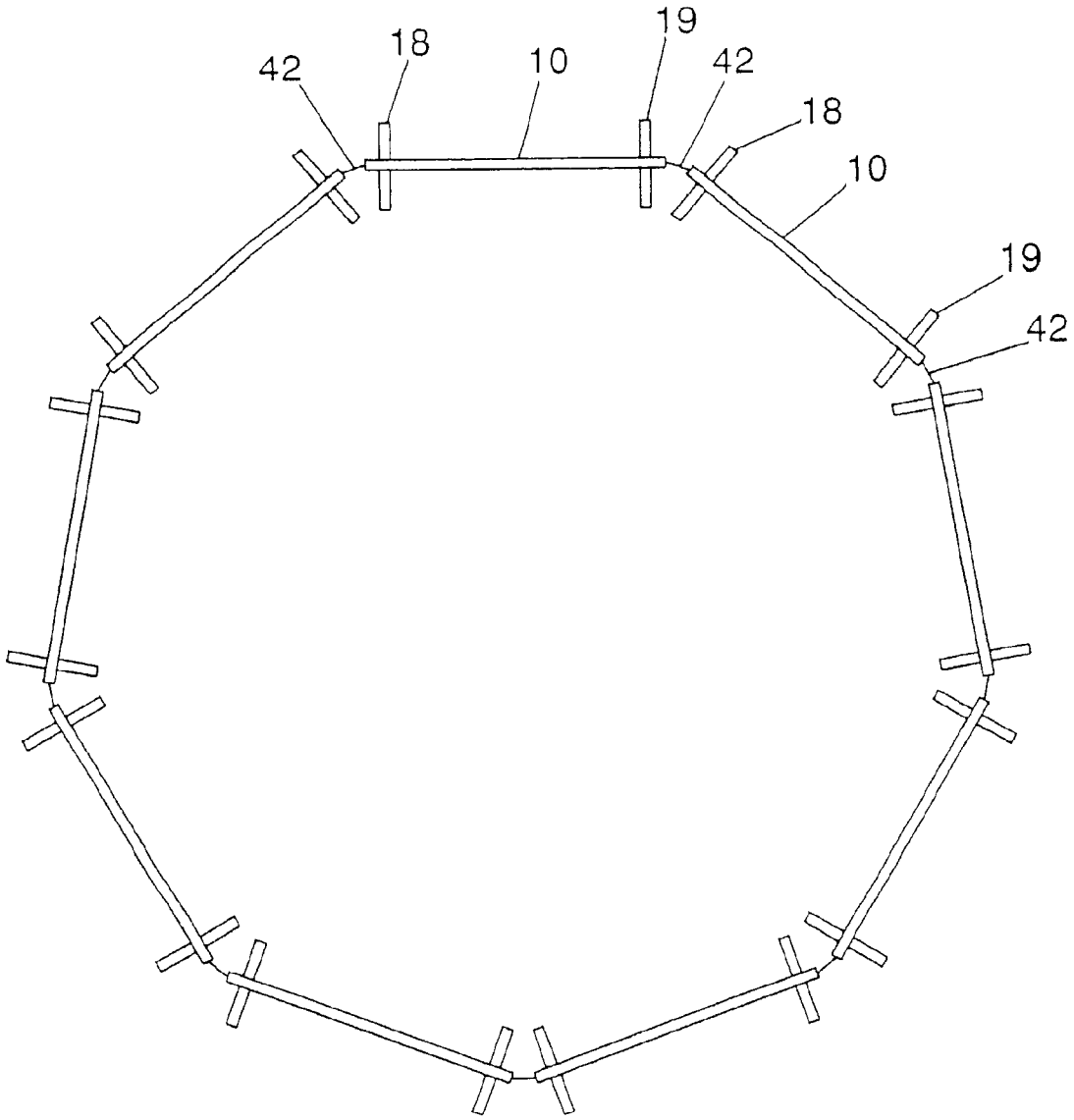
FIG. 7 is top view of the panels forming a ring design.

As shown in FIG. 4, bars, such as flat bars or tubes 42 having a first end 50 and a second end 52 can be slidably engaged to mount over a second panel pin 40 of a first wall panel 12 and a third panel pin 44 of a second wall panel 14. The bar or tube 42 contains a hole in each end so that the bar or tube can slidably engage with each panel pin 40 and 44, respectively. Panels may then be connected together, in a ring design, such as a triangle or a circle or even a square or rectangle. FIG. 7 shows the panels in the ring design.

Figure 6A:
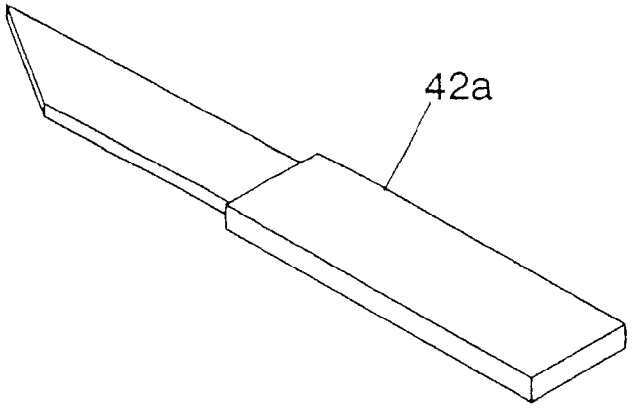
FIG. 6A is a view of the bar telescoping (reference numeral 42A)
Figure 6B:
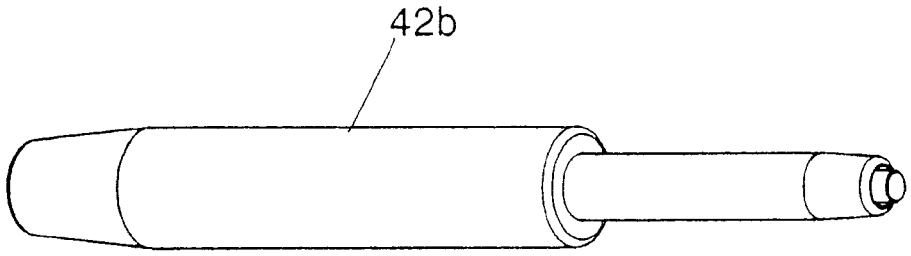
FIG. 6B is a view of the bar as a tube (reference numeral 42B)

It is within the scope of the invention that the bar or tube 42 be telescoping. The telescoping bar 42A is shown in FIG. 6A. The bar as a tube is shown in FIG. 6B. It is also contemplated that in the telescoping embodiment, the bar or tube can be additionally locked or fixed into position.

The freestanding room divider in another embodiment of the invention may be constructed wherein the panels are capable of rotating up to 180 degrees from each other.

In FIG. 5 a first wall panel 12 and a second wall panel 14 are shown for a connected freestanding room divider 10, wherein the freestanding room divider is constructed having at least one panel 12 having four sides: a first top 100, a first bottom 102, a first right side 104 and a first left side 106; and a second panel 14 having four sides: a second top 200, a second bottom 202, a second right side 204 and a second left side 206. In addition to a first rail 16 mounted on or attached to the first bottom side 102 of the first wall panel 12, a second rail 17 is mounted on or attached to the second bottom side 202 of the second wall panel 14. Similar to rail 16, the second rail 17 is attached to at least two braces: a second panel first brace 25 and a second panel second brace 27, which in a preferred embodiment the braces are U-shaped. Second panel first brace 25 is attached to a second vertical member 28*c*, which attaches to second horizontal member 29*c*. Second panel second brace 27 is attached to a second vertical member 28*d*, which attaches to a second horizontal member 29*d*. When horizontal members 29*c* and 29*d* are attached to vertical members 28*c* and 28*d*, respectively, they form T-shaped supports: a second panel first T-shaped support 18*a* and a second panel second T-shaped support 19*a*, respectively. Each T-shaped support can optionally have at least two vertical segments with a second panel first vertical segment 30*e* secured to one end of a second panel first horizontal member 29*c* and a second panel second vertical segment 30*f* secured to the other end of the second panel first horizontal member 29*c*; a second panel third vertical segment 30*g* secured to one end of second panel second horizontal member 29*d* and a second panel fourth vertical segment 30*h* secured to the other end of the of second panel second horizontal member 29*d*. It is within the scope of the invention, when two or more panels are used to construct a freestanding room divider each panel has a rail attached to the bottom of the panel. Specifically, the second panel has a second rail secured or otherwise attached to the bottom of the second panel. It is noted that the same would apply when multiple panels are used to construct a freestanding room divider. Specifically, each panel has a rail secured or otherwise attached to the bottom of each of the panels. It is within the scope of the invention to optionally have additional T-shaped supports with optional additional vertical segments. It is also within the scope of the invention to optionally have additional braces secured to these additional T-shaped supports. The braces 24, 25, 26 and 27, horizontal members 29*a*, 29*b*, 29*c*, and 29*d* and vertical member 28*a*, 28*b*, 28*c* and 28*d* are most preferably made of metal, but could be made from a graphite composite, a laminate structure of metal and plastic, or an extremely durable plastic. Each vertical segment can be secured to rolling means such as wheels. FIG. 5 shows first wall panel 12 having rolling means 32*a* which is attached to vertical segment 30*a*, rolling means 32*b* which is attached to second vertical segment 30*b*, rolling means 32*c* which is attached to third vertical segment 30*c* and rolling means 32*d* which is attached to fourth vertical segment 30*d*. FIG. 5 also shows second wall panel 14 having rolling means 32*e* which is attached to vertical segment 30*e*, rolling means 32*f* which is attached to second vertical segment 30*f*, rolling means 32*g* which is attached to third vertical segment 30*g* and rolling means 32*h* which is attached to fourth vertical segment 30*h*. The rolling means 32*a*, 32*b*, 32*c*, 32*d*, 32*e*, 32*f*, 32*g* and 32*h* can be wheels, casters or rolling balls with fixed claws 34*a*, 34*b*, 34*c*, 34*d*, 34*e*, 34*f*, 34*g* and 34*h*, respectively, disposed over the rolling balls for smooth rolling. The rolling balls with claws further can each comprise a self-leveling device. Locking means 37*a* is mounted on the fixed claw 34*a* in a preferred embodiment for locking the rolling ball 32*a*; locking means 37*b* is mounted on the fixed claw 34*b* in a preferred embodiment for locking the rolling ball 32*b*; locking means 37*c* is mounted on the fixed claw 34*c* in a preferred embodiment for locking the rolling ball 32*c*; locking means 37*d* is mounted on the fixed claw 34*d* in a preferred embodiment for locking the rolling ball 32*d*; locking means 37*e* is mounted on the fixed claw 34*e* in a preferred embodiment for locking the rolling ball 32*e*; locking means 37*f* is mounted on the fixed claw 34*f* in a preferred embodiment for locking the rolling ball 32*f*; locking means 37*g* is mounted on the fixed claw 34*g* in a preferred embodiment for locking the rolling ball 32*g* and locking means 37*h* is mounted on the fixed claw 34*h* in a preferred embodiment for locking the rolling ball 32*h* to prevent rolling of the room dividers 10. Baffles 47 can be mounted upward on the top of the panel to increase the panel noise reduction efficiency. Multiple baffles optionally can be mounted on the top of one or more panels used in the freestanding room divider. As previously described, a first panel pin 38 and a second panel pin 40 are disposed on each of the ends, a first end and a second end of the top 100 of the panel 12. A third panel pin 44 and a fourth panel pin 45 are disposed on each of the ends, a first end and a second end of the top 200 of the panel 14. A bar 42 having a first end 50 and a second end 52 can be slidably engaged to mount over a second panel pin 40 of first wall panel 12 and third panel pin 44 of a second wall panel 14 to connect first wall panel 12 and second panel 14. The invention further comprises connecting multiple panels to construct a freestanding room divider having the desired shape in a ring design, such as a triangle or a circle or even a square or rectangle. However, it is noted that the scope of the invention is not limited to only these shaped designs. Handles 46 may be mounted on the sides of the panels to facilitate moving the panels on the wheels.

The freestanding room divider in another embodiment of the invention may include panels, which have a white board (200 in FIG. 1), bulleting board (202 in FIG. 1), a black board (204 in FIG. 2), a bookshelf (206 in FIG. 2 with books 208), a television or a computer monitor (212 in FIG. 5), and a fabric (214 in FIG. 5) and combinations of these attached or disposed in the panel space.

The freestanding room divider in another embodiment of the invention may further comprises a bar 42 as shown in FIG. 4 which can bridge the gap between said first panel and said second panel when the bar is in the telescoping position.

It is within the scope of the invention that the wall panels be additionally connected to immediately adjacent panel(s) by hinges (not shown) so that the panels can be readily folded for storage or unfolded to form a wall.

The panels can be folded forming a cart to permit the room divider to be easily moved to a place of use.

In use, the room divider 10 is moved easily into an area to be divided. The room divider 10 is positioned where desired to divide the area into one or more predetermined private areas. The panels 12 and 14 pivot on the pins 40 and 44 and unfolded to form a wall of the desired angular construction.

When it is desired to disassemble the wall and store the wall panels 12 and 14, the brakes, if any, on the rolling means 32*a*, 32*b*, 32*c*, 32*d*, 32*e*, 32*f*, 32*g* and 32*h* can be unlocked and the T-shaped supports 18 and 19 can be removed or slide along rail 16, and the T-shaped supports 18*a* and 19*a* can be removed or slide along rail 17 to allow the panels to be folded.

The freestanding room divider in another embodiment of the invention may further comprise a 'concertina': a foldable screen made of sound-proofing materials disposed between the first panel and the second panel, such a foldable screen may be disposed between all panels used (multiple panels) to construct a freestanding room divider for having added privacy.

It will be apparent to those skilled in the art from the foregoing description and the drawings that the present invention provides a very convenient, inexpensive and flexible means for dividing large areas into smaller more private areas. The walls that are formed can be straight, angular or partially folded. The walls can be the width of a single wall panel or any multiple thereof and within limits they can extend in any direction.

It also will be apparent to those skilled in the art that a number of changes and modifications can be made without departing from the spirit and scope of the invention. For example, the wall panels can further comprise a window, shelf, white board, bulleting board, or similar addition. The wheels or casters may take forms other than those shown and described. Therefore, it is intended that the invention not be limited except by the claims.

What is claimed is:

1. A freestanding room divider comprising:

a. a first panel comprising a first top, a first bottom, a first right side, a first left side;

b. a second panel comprising a second top, a second bottom, a second right side, a second left side;

c. a first rail attached to said first bottom;

d. a second rail attached to said second bottom;

e. a first panel first brace and a first panel second brace engaging the first rail and the first panel, and a second panel first brace and a second panel second brace engaging the second rail and the second panel, and said first and second braces each further comprises at least one U-shaped vertical member attached to at least one horizontal member; each said U-shaped horizontal member having disposed thereon extending locking lips engaging said panels;

f. a first panel pin and a second panel pin disposed on said first top;

g. a third panel pin and a fourth panel pin disposed on said second top; and h. a bar having a first end and second end wherein said first end engages said second panel pin and said second end engages said third panel pin.

2. The freestanding room divider of claim 1, wherein the panels are capable of rotating up to 180 degrees from each other.

3. The freestanding room divider of claim 1, further comprises a bar, which can bridge the gap between said first panel and said second panel when the bar is in a telescoping position.

4. The freestanding room divider of claim 1, wherein the bar is telescoping.

5. The freestanding room divider of claim 1, wherein the bar is a member of the group: a flat bar and a tube.

6. The freestanding room divider of claim 1, further comprising a rolling means that comprises a member of the group: a caster, and a rolling ball and fixed claw configuration.

7. The freestanding room divider of claim 6, wherein the rolling means further comprises brakes.

8. The freestanding room divider of claim 1, wherein the panels have a first side and a second side which can be replaced with a member of the group: a white board, a bulletin board, a black board, a bookshelf, a television, a computer monitor, and a fabric.

9. The freestanding room divider of claim 1, wherein said panels are connected forming a ring design.

10. The freestanding room divider of claim 1, wherein said panels are manufactured from sound absorbing materials, wherein said sound absorbency may be further enhanced with baffles.

11. The freestanding room divider of claim 1, further comprising a foldable screen disposed between said first panel and said second panel.

12. The freestanding room divider of claim 11, wherein said foldable screen is made of sound-proofing material.

* * * * *